United States Patent [19]

Kneip et al.

[11] 4,350,017

[45] Sep. 21, 1982

[54] CRYOSTAT STRUCTURE

[75] Inventors: George D. Kneip, Menlo Park; John H. Broshear, East Alviso; Marvin H. Anderson, Mountain View, all of Calif.

[73] Assignee: Varian Associates, Inc., Palo Alto, Calif.

[21] Appl. No.: 205,118

[22] Filed: Nov. 10, 1980

[51] Int. Cl.[3] ..... F17C 7/02

[52] U.S. Cl. ..... 62/50; 62/54; 220/85 VS; 220/367

[58] Field of Search ..... 62/45, 50, 54; 220/367, 220/85 VR, 85 VS

[56] References Cited

U.S. PATENT DOCUMENTS

| | | | |
|---|---|---|---|
| 3,260,060 | 7/1966 | Pauliukonis et al. | 62/45 |
| 3,298,187 | 1/1967 | Short | 62/50 |
| 3,688,514 | 9/1972 | Prost | 62/45 |
| 3,705,498 | 12/1972 | Dehaan | 62/54 |
| 4,187,956 | 2/1980 | Schrawer et al. | 62/54 |

*Primary Examiner*—Ronald C. Capossela

*Attorney, Agent, or Firm*—Stanley Z. Cole; Edward H. Berkowitz

[57] ABSTRACT

The thermal loss incurred through a fill and vent conduit of a cryostat is minimized by inclusion therein of a central coaxial member. Thermal energy transfer is desirably promoted by radiation between the interior surface of the fill and vent tube and the central coaxial member by enhancement of the emissivity of the respective facing surfaces. For a tubular central member dual paths to respective pressure relief valves are obtained.

10 Claims, 2 Drawing Figures

CRYOSTAT STRUCTURE

DESCRIPTION

BACKGROUND OF THE INVENTION

This invention is in the field of cryostat apparatus for the containment of very low temperature liquefied gasses such as liquid helium and in particular relates to filling and venting structures for such apparatus.

Improvements in cryostat structures for the containment of liquid gas have resulted in progressively lower boil-off rates for the contained cryogen and consequently result in extended containment time for the liquefied gas. Such improvements in cryostat performance result from a variety of improved thermal designs for reduction of thermal losses attributable to conductive and radiative heat transport mechanism. Representative of such advancements are improvements in heat transfer from radiation shields as described in U.S. Pat. No. 4,212,169, and in U.S. Ser. No. 164,451 now U.S. Pat. No. 4,291,541 issued Sept. 29, 1981. Cryostat structures featuring a plurality of nested structures exhibit direct conduction losses through internal bracing required to maintain the spacings of adjacent nested structures. Reduction of such losses is reported in U.S. Ser. No. 164,451 now U.S. Pat. No. 4,291,541 issued Sept. 29, 1981. Radiation losses have been reduced between adjacent surfaces of nested aluminum cryostat structures in accordance with a surface treatment for reduction of emissivity as described in U.S. Ser. No. 879,290.

Where the cryostat further contains a set of superconducting solenoids including a plurality of shim coils, it was recognized that the control channels for such solenoid and shim coils forms a thermal conductive path from ambient surroundings to the central region of the cryostat and that the thermal conductance over such thermal paths could be reduced by selective addressing arrangements for such coils as described in U.S. Pat. No. 4,173,775.

A principal thermal loss path can be identified with convective and radiative losses incurred through the necessary fill and vent tubes for such cryostats. In the prior art, it is known to reduce radiative thermal transport over this path by installation of plane baffles in the fill and vent conduit which baffles occlude a major portion of the cross-section tube. A representative work dealing with the use of plane baffles in this context is reported by Lyman et al. Reduction in cross-section of the fill and vent conduit affects the filling procedure adversely and further, can occasion some concern for safety. A latent hazard may be discerned in the effect of air infiltration down the fill and vent tube. At an appropriate thermal location, liquefaction occurs and the condensed liquid air is mobile along the inner surface of the tube under the influence of gravity. As this condensate creeps down the fill and vent tube toward a cryogen such as liquid helium, solidification occurs and the accumulation of such solid air (hereinafter referred to as "ice") forms a plug in the fill and vent conduit. The occurrence of such a plug can have catastrophic results unless measures are taken to relieve the pressure of the boiling cryogen. It is known in the prior art to provide a relatively large diameter conduit disposed concentrically with respect to the fill and vent tubes and arranged in communication with a "high" pressure relief valve and to establish from the annular region (between such concentric tubes) another pressure relief path through another ("low" pressure) relief valve. The central pressure relief path communicating with the high pressure relief valve is filled with vapor from the boiling cryogen and protected from air infiltration. The annular space communicating with the low pressure relief valve is possibly subject to plugging as described above. In such instance, the alternate path provides pressure relief protecting the prior art cryostat from explosion.

BRIEF DESCRIPTION OF THE INVENTION

It is an object of the present invention to extend the containment time of a liquefied gas in a cryostat by reduction of the rate of vaporization of such liquefied gas.

It is another object of the present invention to provide dual pressure relief paths for the vapor evolved from such liquefied gas.

In one feature of the present invention a fill and vent conduit includes a first thermally resistive outer tube communicating between a central cryogen reservoir and the exterior of a cryostat, and a second thermally resistive tube disposed within said first tube.

In another feature of the invention said first tube communicates with a pressure relief valve disposed to open when the interior pressure due to vaporized cryogen exceeds the ambient pressure by a selected small magnitude and an alternate pressure relief path defined by a generally annular space between first and second tubes communicates with another pressure relief valve disposed to open at a pressure difference somewhat higher than that of the first relief valve.

In still another feature of the present invention either or both adjacent surfaces of said first and second tubes are treated to enhance the emmisivity of said surfaces and thus promote the heat transfer by radiation therebetween.

In the present invention the primary coolant (hereinafter, liquid helium) is contained in a central reservoir formed of aluminum and provided with a bore through its center defined by a cylindrical wall welded to the reservoir. A superconducting solenoid is disposed within the cryostat and surrounding the bore as described.

The central reservoir is provided with a fill and vent tube which communicates directly with the exterior of the cryostat through structure to be described, to allow the filling of the central reservoir and to provide dual paths to atmosphere for the vapor of the boiling cryogen of the central reservoir.

The first radiation shield surrounding the helium reservoir is provided to establish a first isothermal surface intermediate the central reservoir and another isothermal surface surrounding the first radiation shield. The second isothermal surface is maintained at the temperature of a secondary coolant (hereinafter, liquid nitrogen). The first radiation shield is maintained at about 50° K. through vapor cooling derived from the vapor of liquid helium boil-off escaping up the fill and vent tube with which the radiation shield is in thermal contact.

Surrounding the radiation shield and partially surrounding the fill and vent tube, there is provided as above described a second isothermal shell cooled by a thermal contact with a liquid nitrogen reservoir disposed externally of the shell, and above the region of the central reservoir. In this geometry the vent and fill tube in the central reservoir (partially surrounded by a cylindrical portion of the secondary isothermal shell) passes through a greater length of the secondary coolant reservoir (as compared to prior art cryostats) with substantially improved thermal isolation for the liquid helium reservoir.

The secondary coolant reservoir and associated secondary isothermal shell are again surrounded by an outer radiation shield maintained at a temperature intermediate the secondary coolant and ambient temperature. This thermal maintenance may be accomplished by means of heat transfer to vapor boil-off from the liquefied gasses escaping through their respective fill and vent tubes and/or the outer radiation shield may be independently cooled from an external refrigerating apparatus.

An outer hermetically sealed vessel encloses the outer radiation shield and the interior of the cryostat permitting the spaces between adjacent nested surfaces to be evacuated to a pressure of the order of $10^{-6}$ torr prior to filling with cryogenic liquids. After filling with the cryogenic fluids, the pressure will be still lower than the nominal $10^{-6}$ torr (due to cryopumping on the cold surfaces). In this way, gas conduction and convection mechanisms are minimized for the reduction of heat transport from ambient environment to the central reservoir.

The fill and vent tube leading to the central reservoir is constructed of thin stainless steel providing a substantial thermal impedance. Disposed along the interior of the central reservoir fill and vent tube is another stainless steel tube of substantially smaller diameter whereby the annular area defined between the two nested tubes is substantially larger than the cross-sectional area of the centrally disposed tube. This relatively large area is closed with a relatively high pressure relief valve at all the times. The centrally disposed tube communicates through a flowmeter to a relatively low pressure relief valve and is, therefore, the normal venting path. Filling of the central reservoir is accomplished by withdrawal of the central tube to make available the entire cross-sectional area of the fill and vent tube for the filling operation.

Direct conduction losses between the nested structures of the cryostat are reduced and mechanical support obtained through tensilely stressed internal bracing with polyester cords.

All of the walls forming the nested structures of the cryostat are constructed of aluminum, save for the fill and vent tubes in both the liquid nitrogen and helium reservoirs, which are stainless steel. The aluminum surfaces are subject to treatments for reduction of radiant emissivity of the respective surfaces.

Further features and advantages of the present invention will become apparent from the following specification taken in connection with the accompanying drawings.

DESCRIPTION OF THE PREFERRED EMBODIMENT

Figure 1:
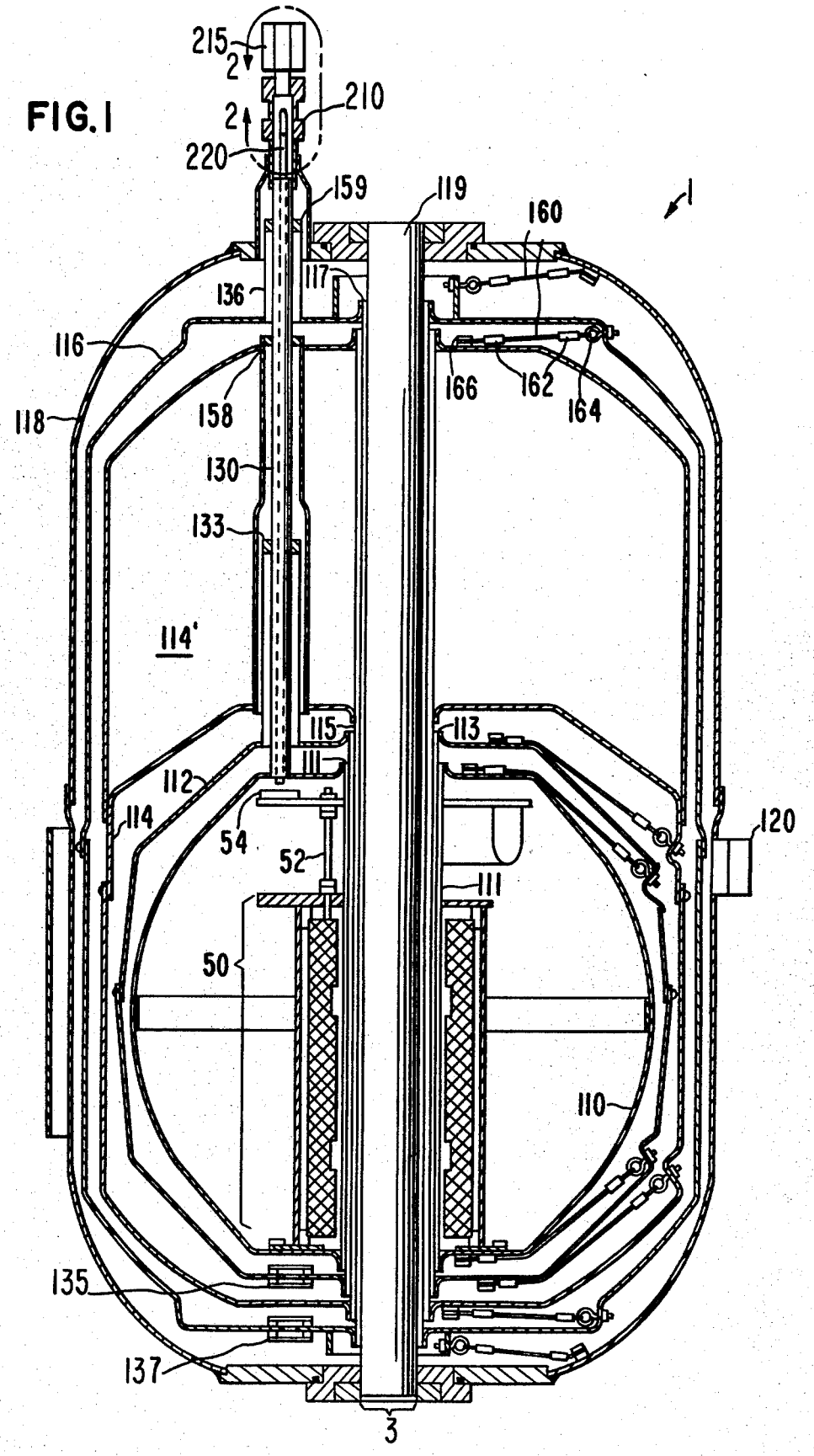
FIG. 1 is a section through the cryostat of the present invention.

The present invention is shown described with the aid of the cross-section of the cryostat of FIG. 1.

A superconducting NMR spectrometer system employs a cryostat 1 having a room temperature access to the magnetic field created within the cryostat 1 through a bore 3 along the axis of the cryostat.

The cryostat 1 contains a superconducting solenoid assembly 50 within a central reservoir 110. Reservoir 110 contains a primary coolant, preferably liquid helium, to maintain the superconducting state of the windings, the latter comprising a solenoid assembly 50. Leads from the solenoid windings, collectively denoted 52, terminate in a connector 54 for access to external current sources introduced in a manner as described in U.S. Pat. No. 4,173,775. The construction of the solenoid assembly 50 is not within the scope of the present invention and is further described in U.S. Pat. Nos. 4,180,769 and 4,213,092, both assigned to the assignee of the present invention.

Central coolant reservoir 110 is formed from 0.125" thick aluminum formed to a substantially spherically shaped shell by spinning techniques well known in the art. In the preferred embodiment, reservoir 110 has a coolant capacity of about 25 liters. Reservoir 110 is further characterized by a bore formed by cylindrical wall 111, welded to reservoir 110. Room temperature access is thereby afforded to the magnetic field of solenoid assembly 50 on the axis thereof. Reservoir 110 is isolated from ambient temperature by means of a plurality of consecutively nested surrounding chambers 112, 114, 116 and 118 having coaxial bores defined by cylindrical tubes 113, 115, 117 and 119, respectively. The wall thickness of each of the respective cylindrical coaxial tubes is determined by the heat load on each and varies from 0.02" to 0.049". The spaces between chambers 112, 114, 116 and 118 are mutually communicating in a manner described below and evacuated through pumpout port 120 in exterior chamber 118 to achieve a very low pressure as for example $10^{-6}$ torr to minimize thermal conduction between adjacent nested surfaces through gas conduction and convection.

A secondary coolant reservoir 114' is disposed above central reservoir 110 and in thermal contact with chamber 114 whereby chamber 114, preferably formed of nominal 0.190" aluminum, comprises an isothermal shell at the temperature of the secondary coolant, preferably liquid nitrogen.

Vent and fill tube 130 communicates from the external environment of the cryostat to the central reservoir 110. Tube 130 is preferably of stainless steel in order to minimize thermal conductivity from the liquid helium reservoir to the exterior of the cryostat. Tube 130 is necessarily shielded by coaxial tubes 132, 134, 136 and 138, each of which form part of the respective nested chambers 112, 114, 116 and 118. Thermal transfer collar 133 serves to transfer heat to the boil-off helium vapor passing through tube 130, thereby to maintain isothermal shell 112 at a fixed temperature. A second central reservoir fill and vent tube, identical to the above described construction, is not shown. The second fill and vent tube while serving as still another dual path pressure relief means serves as the conduit for electrical control and power to the superconducting solenoid in the central reservoir 110. For convenience, the electrical control and power connector 54 is shown in FIG. 1 positioned under one such fill and vent tube. One need only recall that the connector 54 is positioned under only one such fill and vent tube. It is noted that yet another fill and vent tube communicating with reservoir 114' is not shown therein. This structure may be ascertained from U.S. Pat. No. 4,212,169 and/or Ser. No. 164,451 now U.S. Pat. No. 4,291,541 issued Sept. 29, 1981. Thermal transfer collar 133, preferably of aluminum, serves to transfer heat to the boil-off helium vapor passing through tube 130 thereby to maintain isothermal shell 112 at a fixed temperature.

Radiation shield 112 is preferably constructed of aluminum by conventional spinning techniques and defines an isothermal shell of temperature intermediate the secondary coolant (liquid nitrogen at 77.4° K.) and the primary coolant (liquid helium at 4.2° K.). For a liquid nitrogen-liquid helium combination, the temperature of the radiation shield 112 is optimized at about 50° K. Heat is transferred to the radiation shield principally by radiation from the interior of surrounding shell 114 and by conduction through mechanical bracing therebetween and heat is again transferred from the radiation shield 112 to the helium vapor in the fill and vent tube 130 through the aluminum contact collar 133 which is welded to the fill and vent tube 130 and to radiation shield 112. Thermal contact between tube 130 and collar 133 occurs at a point where approximately 10 mw. of thermal power is supplied to the escaping helium vapor from radiation shield 112.

Surrounding radiation shield 112, there is disposed another isothermal shell 114 maintained at liquid nitrogen temperature by welded contact with liquid nitrogen reservoir 114'. The outer surface of the isothermal body 114–114' is itself shielded by outer radiation shield 116 which is maintained at a temperature intermediate that of liquid nitrogen and room temperature as described more fully below.

Hermetically sealed external vessel 118 encloses the cryostat structure and provides mechanical and vacuum integrity.

Figure 2:
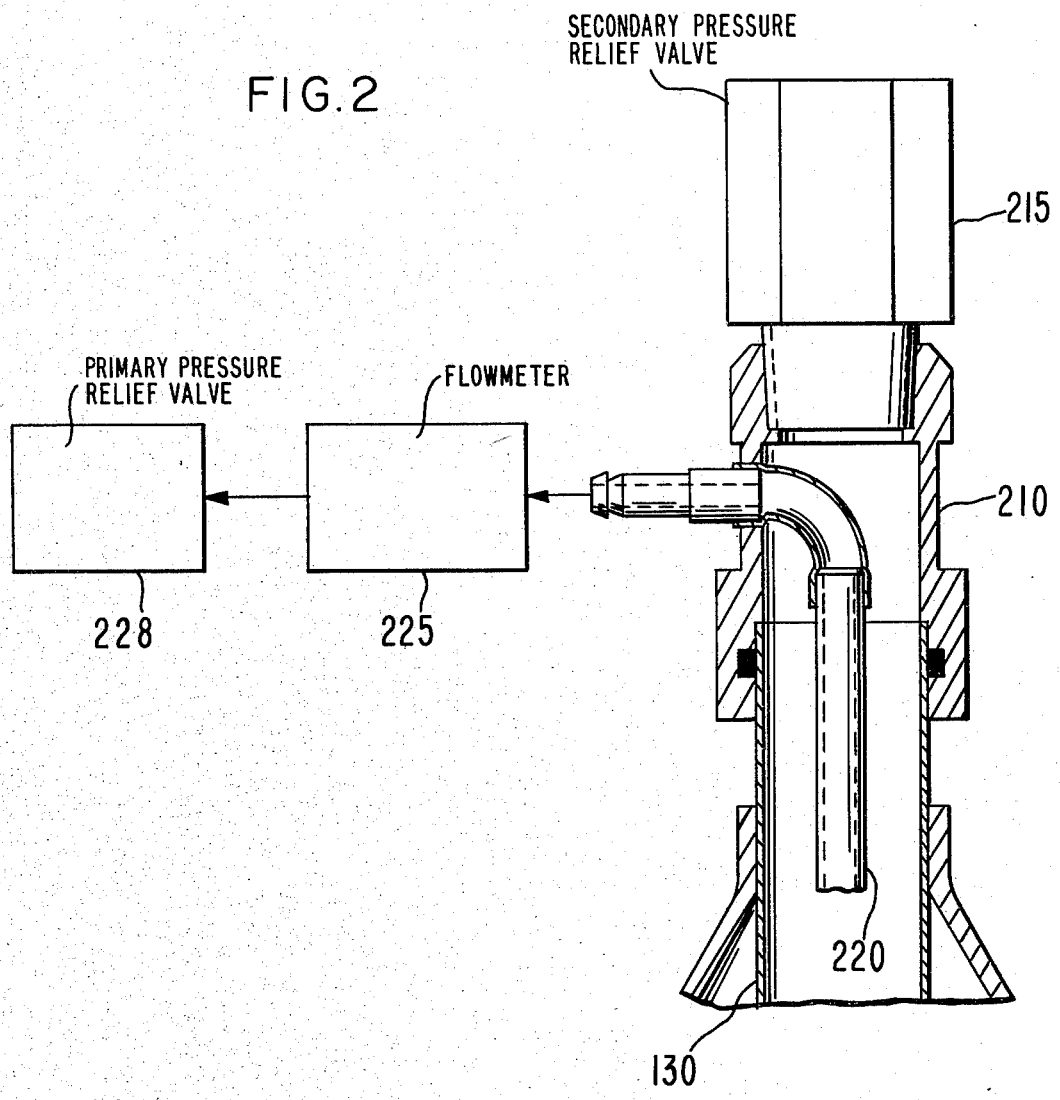
FIG. 2 is a partial detail of the section of FIG. 1.

Baffle apertures 135 and 137 are provided in radiation shields 112 and 116 as shown. A similar baffled aperture in shell 114, not visible in the section of FIG. 2, provides a communication between all interior spaces of the nested structure whereby these interior spaces are maintained at a common pressure by evacuation through port 120.

The liquid nitrogen reservoir 114' and associated shell 114 are effectively insulated by cooling outer radiation shield 116 to a temperature intermediate between that of liquid nitrogen and ambient temperature. Maintaining radiation shield 116 at preferably 235° K. is accomplished by providing a heat exchange to the escaping helium and nitrogen vapors in a manner similar to that of the inner radiation shield or alternatively, by providing for heat transfer to an externally disposed independent refrigerating apparatus as described more fully in the above referenced U.S. Pat. No. 4,212,169.

The central reservoir 110, radiation shield 112, liquid nitrogen reservoir 114' and shell 114, outer radiation shield 116 and containment vessel 118 are fabricated from aluminum alloy, preferably alloy 1100-0. This alloy is well-known and commercially available from several manufacturers. After the above-listed bodies have been formed by spinning, the interior adjacent spacing surfaces the respective bodies are subject to a surface treatment as described more fully in U.S. Ser. No. 879,290 resulting in the reduction of emissivity of these surfaces by approximately 35%.

The nested structure of a cryostat, such as exhibited by the present invention, requires internal mechanical support to maintain spacings and centering of the various shells and coaxial alignments and close tolerances therebetween. It is important that the coaxial tubes 111, 113, 115, 117 and 119 forming the bore for room temperature access be precisely located. Mechanical constraints which accomplish this bracing form a thermally conductive path for heat transport. Minimization of heat transport over this path is described in Ser. No. 164,451 now U.S. Pat. No. 4,291,541 issued Sept. 29, 1981. It will be perceived that adjacent members of the nested structures 110, 112, 114 and 114', 116 and 118 are subject to spacing constraints through the tensioned polyester cords as shown. In the interest of clarity, a representative spoke 160 is designated. The representative spacings between adjacent coaxial bore tubes are described more fully in the above referenced U.S. Pat. No. 4,212,169.

Turning now to FIG. 2, the specific improvement of the present invention is shown in greater detail. Closure of fill and vent tube 130 is obtained by the combination of pressure relief valve 228 and fitting 210. A fitting 210 is adapted to communicate with fill tube 130 and to receive a high pressure relief valve 215. Fitting 210 may be removed for the purpose of filling the central reservoir. Another tube 220 disposed within vent tube 130 communicates through the lateral wall of fitting 210 to discharge vaporized liquid helium through a flowmeter 225, thence to primary relief valve 228. The latter is typically adjusted to open at approximately ½ psi while secondary pressure relief valve 215 is typically adjusted to open at approximately 1 psi. While air infiltration is minimized by primary pressure relief valve 228, the diffusion and subsequent condensation and solidification of infiltrating ambient air in the interior of tube 220 will not result in catastrophic failure because an alternate pressure relief path is available through secondary pressure relief valve 215.

In a construction according to the described invention, control tube 220 is of ¼" O.D. stainless steel (0.006" wall). The O.D. of fill and vent tube 130 is ⅝" (0.006" wall); thus a nominal 0.185" clearance between these tubular surfaces is obtained. The cross-section ratio for the area of the annular space outside of tube 220 to the interior sections of tube 220 is about 4.5. Thus, the secondary pressure relief path is characterized by a particularly low relative pressure impedance. This is particularly important in the present application because the quenching of the superconducting solenoid is an anticipated event requiring immediate pressure relief to avoid destruction.

The provision of the additional tube 220 within vent tube 130 has been found to dramatically reduce the boil-off rate from the central reservoir.

A typical measurement of boil-off rate for the cryostat as above described, but without the tube 220, yields 11 cc/hr of liquid helium consumed. The same cryostat adapted in accord with the preferred embodiment exhibits 8 cc/hr. These measurements are believed to indicate the magnitude of a combination of convective and radiative transport along the thermal path defined by the interior of tube 130 (together with residual thermal losses of various origins).

The open and unobstructed path through tube 130 in the absence of the present inventive contribution permits unimpeded radiation transport from the liquid helium surface in the interior of reservoir 110 to ambient temperature at closure of tube 130. In like manner, the set of convective loop currents are believed to be established along the entire length of such an open tube. These take the form of relatively cool downward directed vapor along the center of the open tube 130 and relatively warmer vapor rising in proximity to the walls of tube 130. Observations consistent with this model have been reported by Boardman et al., Cryogenics, Vol. 13, pp. 520–523 (1973). In investigating these losses, plane aluminum baffle plates occluding about 90% of the cross-section of the interior of tube 130 were installed on a thin plastic rod and suspended inside tube 130. These baffle plates were positioned at the location of thermal transfer collars 133 and 159. The boil-off rate was found to be reduced by about 10% in the presence of these baffles. It is hypothesized that such baffles present an impedance requiring radiation absorption at the upper surface of each baffle plate followed by conductive transfer through the baffle and reemission from its lower surface. Moreover, the convective flow for this arrangement is divided into at least 3 cells by the two baffles requiring heat transfer at the respective baffle surfaces. Heat transfer losses at interfaces of the convective cells aids in securing the desired improved isolation.

Cross-section baffles, as above described, do not represent a desirable means for increasing thermal impedance because the "ice" plugging effect is somewhat enhanced and the baffles may become frozen to the interior wall of the vent and fill tube preventing their removal when it is desired to fill the reservoir.

The fill and vent tube 130 and the central tube 220 are preferably arranged in a radiant heat exchanging relationship. That is, the adjacent facing surfaces of tubes 130 and 220 are treated to enhance the emissivity and thereby promote radiation emission and absorbtion between the surfaces. These tubes clearly support a longitudinal thermal gradient; the radiation enhancement between these surfaces serves to reduce or minimize any radial thermal gradient. As a result, radial components of convective currents in the annular region between these surfaces are similarly minimized and longitudinal components of convective currents are subject to somewhat higher effective thermal impedance through heat exchange with the respective inner surface of tube 130 and outer surface tube 220.

The central tube 220 of the preferred embodiment is hypothesized as forming an axially distributed baffle. Radiant energy present in the region of the closure of the vent and fill tube is multiply reflected between the adjacent inner surface of tube 130 and the outer surface of tube 220. The facing adjacent surfaces of tubes 130 and 220 are treated to enhance the emissivity thereof with the effect that incident radiation is absorbed and does not propagate to any significant degree along the interior of the fill and vent tube 130. The axial radiation flux through the interior of tube 220 is reduced in cross-section and thereby the size of this loss is severely reduced. Moreover, the small diameter central tube 220 presents an added gas flow impedance by reduction of the effective cross-section of the primary venting path thus serving to reduce the thermal transport by convective currents down the central tube.

The relative contribution of radiative and convective losses through the fill and vent tube 130 were investigated by substituting a solid cylindrical member for tube 220. For this measurement, a nylon rod of identical cross-section was suspended from fitting 210 and the boiling rate was measured by means of a flowmeter 225 and inserted in series with a relief valve 228. Within the limits of the measurements, the boil-off rate was found to be identical with that obtained when the cylindrical baffle was tubular in accordance with the preferred embodiment. Accordingly, an embodiment comprising a solid cylindrical body as a distributed baffle will function with similar thermal advantage. However, such embodiment sacrifices a safety feature of an alternate gas pressure relief path.

It has also been noted that the improved thermal properties of the present invention are not sensitive to departures from the coaxial disposition of central tube 220 within filament tube 130. With the lower end of tube 220 in contact with the inner wall of tube 130, no appreciable degradation in peformance was noted.

Since many changes can be effected in the construction describedf above and many apparently widely differing embodiments of this invention could be constructed without departing from the scope thereof it is intended that all matter contained in the above description and shown in the accompanying drawings shall be interpreted as illustrative and not in a limiting sense.

We claim:

1. A cryostat comprising an inner reservoir for containing a cryogenic liquid, and outer shells surrounding said reservoir, a fill and vent tube communicating from said inner reservoir through said outer shell and a cylindrical baffle disposed interiorly of said fill and vent tube, said cylindrical baffle comprising another tube having an outer diameter substantially smaller than the inner diameter of said fill and vent tube, said interior of said another tube adapted to communicate with the exterior of said outer shell through a low pressure relief valve, and the annular conduit space formed between the exterior of said another tube and the interior of said fill and vent tube adapted to communicate with the exterior of said outer shell through a relatively high pressure relief valve.

2. The apparatus of claim 1 wherein said another tube is limited in length so as not to protrude into the volume of said inner reservoir.

3. The apparatus of claim 2 wherein said fill and vent tube and said another tube comprise stainless steel.

4. The apparatus of claim 3 wherein the outer surface of said another tube exhibits enhanced radiant emissivity.

5. The apparatus of claim 3 or 4 wherein the inner surface of said fill and vent tube exhibits enhanced radiant emissivity.

6. A cryostat comprising an inner reservoir for containing a cryogenic liquid, and outer shells surrounding said reservoir, a fill vent tube communicating from said inner reservoir through said outer shell and a cylindrical baffle disposed interiorally of said fill and vent tube, said cylindrical baffle comprising a solid cylindrical non-thermal conducting member having an outer diameter substantially smaller than the inner diameter of said fill and vent tube, the annular conduit space formed between the exterior of said solid cylindrical body and the interior of said fill and vent tube adapted to communicate with the exterior of said outer shell through a relatively low pressure relief valve.

7. The apparatus of claim 6 wherein said solid cylindrical body is limited in length so as not to protrude into the volume of said inner reservoir.

8. The apparatus of claim 7 wherein said fill and vent tube comprises stainless steel and the solid cylindrical member comprises nylon.

9. The apparatus of claim 8 wherein the outer surface of said solid cylindrical body is treated to increase the emissivity thereof.

10. The apparatus of claim 8 or 9 wherein the inner surface of said fill and vent tube is treated to increase the emissivity thereof.

* * * * *